US006471335B1

(12) United States Patent
Gelbart

(10) Patent No.: US 6,471,335 B1
(45) Date of Patent: Oct. 29, 2002

(54) METHOD FOR MUTUAL SPATIAL REGISTRATION OF INKJET CARTRIDGES

(75) Inventor: Daniel Gelbart, Vancouver (CA)

(73) Assignee: Creo Inc., Burnaby (CA)

( * ) Notice: Subject to any disclaimer, the term of this patent is extended or adjusted under 35 U.S.C. 154(b) by 0 days.

(21) Appl. No.: 09/922,150

(22) Filed: Aug. 6, 2001

(51) Int. Cl.[7] ..... B41J 2/155
(52) U.S. Cl. ..... 347/49; 347/13; 347/42
(58) Field of Search ..... 347/12, 13, 42, 347/49

(56) References Cited

U.S. PATENT DOCUMENTS

| | | | | |
|---|---|---|---|---|
| 5,065,170 A | | 11/1991 | Rezanka et al. | 347/42 |
| 5,160,945 A | * | 11/1992 | Drake | 347/42 |
| 5,241,325 A | | 8/1993 | Nguyen | 347/49 |
| 5,408,746 A | | 4/1995 | Thoman et al. | 29/890.1 |
| 5,617,128 A | | 4/1997 | Thoman et al. | 347/87 |
| 5,646,665 A | | 7/1997 | Swanson et al. | 347/87 |
| 6,068,367 A | * | 5/2000 | Fabbri | 347/49 |
| 6,224,192 B1 | | 5/2001 | Robinson et al. | 347/49 |
| 6,250,738 B1 | * | 6/2001 | Waller et al. | 347/42 |

* cited by examiner

*Primary Examiner*—Anh T. N. Vo
(74) *Attorney, Agent, or Firm*—Oyen Wiggs Green & Mutala

(57) ABSTRACT

A method is presented for aligning the nozzles of a number of individual inkjet cartridges that are combined to create a multiple inkjet head array for an inkjet printer. The method includes fabricating spatially referenced inkjet cartridge sub-assemblies by permanently attaching an intermediate fixture member to pre-made inkjet cartridges whilst referencing the intermediate fixture members to the inkjet nozzle arrays of the inkjet cartridges. The method further includes removably combining a number of such spatially referenced inkjet cartridge sub-assemblies in mutual spatial registration on a common fixture such that the inkjet nozzles of the different inkjet cartridges are all in spatial registration with one another. By this method an array of inkjet heads, of which all the nozzles are in the desired relative positions with respect to one another, is created. This method allows an array head to be maintained or repaired through the removal and substitution of an individual pre-registered inkjet cartridge sub-assembly.

20 Claims, 4 Drawing Sheets

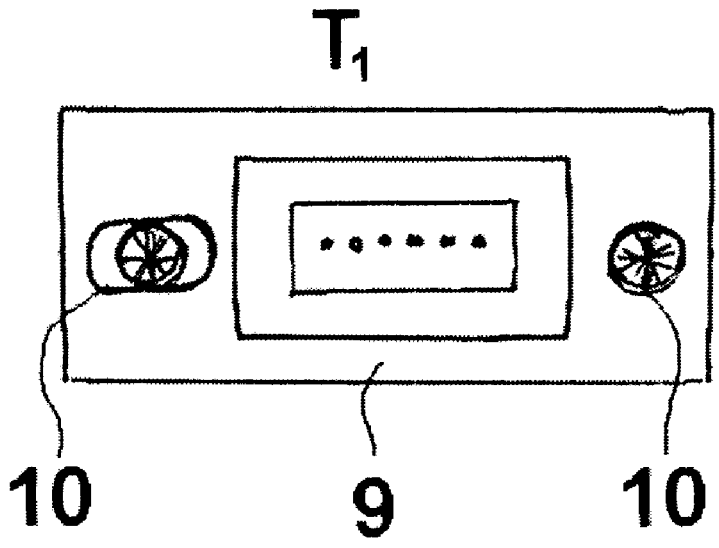
FIG. 4-a
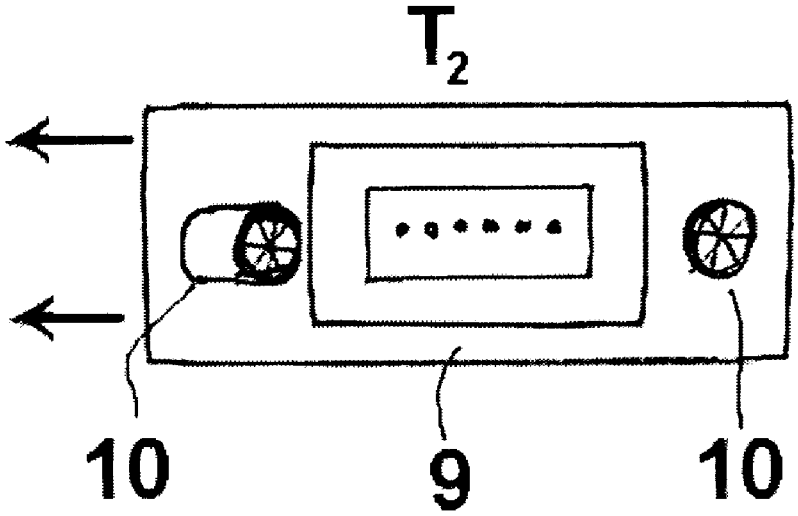
FIG. 4-b

METHOD FOR MUTUAL SPATIAL REGISTRATION OF INKJET CARTRIDGES

FIELD OF THE INVENTION

The invention pertains to the field of inkjet printing and, in particular, to multiple inkjet cartridge array heads.

BACKGROUND OF THE INVENTION

The operating principle of inkjet printheads is based on the ejection of a droplet of ink through a nozzle and onto a recording medium, such as a sheet of paper. The sheet of paper may or may not be specially treated, depending on the ink used and print quality desired. By arranging a plurality of nozzles in a pattern, such as a one- or two-dimensional array, characters or other images may be printed on the paper as the printhead is moved relative to the paper. This is achieved by appropriately sequencing the ejection of ink from the individual nozzles. The paper is typically moved each time the printhead has moved across the paper. The printhead is usually part of a disposable inkjet printer cartridge. To this end, commercial inkjet printer cartridges are designed for easy installation in, and removal from, the printer. The inkjet printer cartridge may contain a reservoir of ink, or the ink supply may also be external to the cartridge.

A typical inkjet cartridge comprises a housing, usually fabricated from plastic, and a nozzle plate, which is sometimes integrated with the nozzle actuators. The actuators are typically thermal or piezoelectric. An ink reservoir may be placed in the housing or ink may be fed to the housing via tubes.

With the advent of multiple inkjet head array products, there is a renewed drive to ensure that the inkjet nozzles of the different inkjet heads constituting the arrays are mutually aligned. Another example is color printing. In the case of color inkjet printing the relative positioning of the different colors of ink is very important, the human eye being extremely capable at detecting consistent deviations in ink dot positions. To this end, much effort has been devoted to ensuring that the various ink dots are correctly positioned in commercial inkjet equipment. In particular, there is a much attention focused on developing so-called "page-wide" devices.

In these machines, the inkjet head array extends across the entire width of the medium upon which printing takes place. This requires little if any motion from the heads and the medium essentially only needs to be moved with respect to an essentially stationary inkjet head array. However, with the very large number of nozzles involved in such systems, the alignment requirement among the multitude of nozzles is extreme. With the nozzles being stationary, there are few solutions available for situations of lateral misalignment between nozzles.

At the same time, much progress has been made towards the commercial production of inkjet cartridges at affordable prices. This has been achieved largely through automation of the manufacturing process. There is therefore much emphasis on obtaining a method for making large inkjet nozzle arrays through the simple expedient of combining commercial inkjet cartridges.

This attractive option is severely complicated by the fact that these products are often made via mass production processes that do not lend themselves to mechanical accuracy. The techniques employed in the fabrication of the actual nozzle assemblies of the cartridges are thoroughly capable of rendering the accuracies required, and the alignment among individual nozzles on a given nozzle assembly is extremely accurate. However, the manufacturing steps for the cartridge housings, and the steps for joining the nozzle assemblies to these cartridge housings, are not of sufficient accuracy. Nor are the materials employed in the manufacture of the cartridge bodies generally chosen with such considerations in mind. As regards commercial inkjet cartridges, the systems designer is therefore confronted with a highly accurate nozzle assembly, containing mutually well-aligned and evenly spaced nozzles, affixed to a cartridge housing of substantially lesser accuracy made via a variety of mass production techniques.

To align the nozzle plates on inkjet printer cartridges in such a way that nozzle plates are positioned in substantially the same location on all the various print cartridges, the nozzle plates are typically glued in position on the inkjet printer cartridges relative to a molded-in plastic datum formed on the inkjet printer cartridge body itself. This alignment process has a significant drawback in that the glue curing process causes nozzle plate to slightly shift as the glue is being cured. In addition, molded-in stresses in the plastic cartridge body creep during the thermal curing process.

Since this movement is substantially unpredictable, this alignment and gluing process can only produce print cartridges of which the nozzle plates are mutually registered to an accuracy of ±35 microns, even if the various cartridges are accurately positioned with respect to one another. This is significantly less accurate than what is required for the positioning of nozzles to provide a resolution of 1200 dots per inch from more than one cartridge and their associated sets of nozzles composed into a single array, as explained above.

Other, more elaborate techniques have been used to achieve higher alignment precision. One of these techniques automatically detects any misalignment of the nozzle plates once the print cartridges have been installed in a carriage, and then mechanically adjusts the positions of the print cartridges in the carriage. Using another relatively expensive method, an ink drop detector within the ink printer measures the location of a drop of ejected ink after being ejected from a nozzle, and a software algorithm compensates for any misalignment of the nozzle plates. Both of these techniques significantly increase the cost of the inkjet printer.

More precise alignment between two or more nozzle plates affixed to print cartridges installed in a single carriage has also been addressed by machining away datum projections on each print cartridge after its nozzle plate has been permanently secured to the print cartridge. The machined datum projections on the print cartridge make contact with surfaces on the carriage when the print cartridge is installed in the carriage such that the dimensions of the datums affect the position of the cartridge, and hence the nozzle plate, within the carriage. The datums on the print cartridge body are machined with reference to targets on the nozzle plate itself so that only rough alignment of the nozzle plate on the pre-machined print cartridge is required. The main disadvantage of this method is that any machining done on the finished cartridge produces debris which may block the inkjet nozzles.

In this particular approach an optical sensor is used to detect a target mark (such as a hole) on the nozzle plate, after the nozzle plate has been securely affixed to the print cartridge and after any adhesive has been fully cured. A mechanical means is then used to precisely position the print cartridge so that the target mark on the nozzle plate is aligned with a reference target stored in a memory. A machining tool is then used to remove portions of the datum projections on the print cartridge to cause the print cartridge, when installed in a carriage, to support the nozzle plate in precisely the same position with respect to the carriage irrespective of any misalignment of the nozzle plate on the pre-machined print cartridge. The machining of the datums may be made to such accuracy, that the overall alignment of the nozzle plates on multiple print cartridges, when installed in the carriage, will have been improved to an accuracy of better than 25 microns.

This technique whilst improving the accuracy in alignment, requires extensive intervention in the manufacturing process of the actual inkjet cartridges and adds further steps to the manufacturing increasing the cost and putting yield at risk. Given the fact that the cartridges are manufactured with the very intention of being disposable, like manufacturing steps of these items need to be kept to an utter minimum for both cost and yield reasons. It has the further drawback that it creates plastic machining dust into an environment where every precaution needs to be taken to avoid particulate continuation near the microscopic inkjet nozzles.

It is an objective of the present invention to provide a method that will allow mass-produced inkjet cartridges, produced to nominal tolerances via the minimum number of manufacturing steps, to be used to fabricate multiple cartridge inkjet arrays that have a high degree of alignment and registration between the nozzles from different cartridges.

BRIEF SUMMARY OF THE INVENTION

A method is presented for aligning the nozzles of a number of individual inkjet cartridges that are combined to create a multiple inkjet head array for an inkjet printer. The method includes fabricating spatially referenced inkjet cartridge sub-assemblies by permanently attaching an intermediate fixture member to pre-made inkjet cartridges whilst referencing the intermediate fixture members to the inkjet nozzle arrays of the inkjet cartridges. The method further includes removably combining a number of such spatially referenced inkjet cartridge sub-assemblies in mutual spatial registration on a common fixture such that the inkjet nozzles of the different inkjet cartridges are all in spatial registration with one another. By this method an array of inkjet heads, of which all the nozzles are in the desired relative positions with respect to one another, is created. This method allows an array head to be maintained or repaired through the removal and substitution of an individual pre-registered inkjet cartridge sub-assembly.

BRIEF DESCRIPTION OF THE DRAWINGS

FIG. 4*a* shows a pre-registered inkjet cartridge subassembly mounted via a slot and hole arrangement on an inkjet carriage. FIG. 4*b* shows the same arrangement as in FIG. 4*a* at a higher temperature.

DETAILED DESCRIPTION OF THE PREFERRED EMBODIMENT

Figure 1:
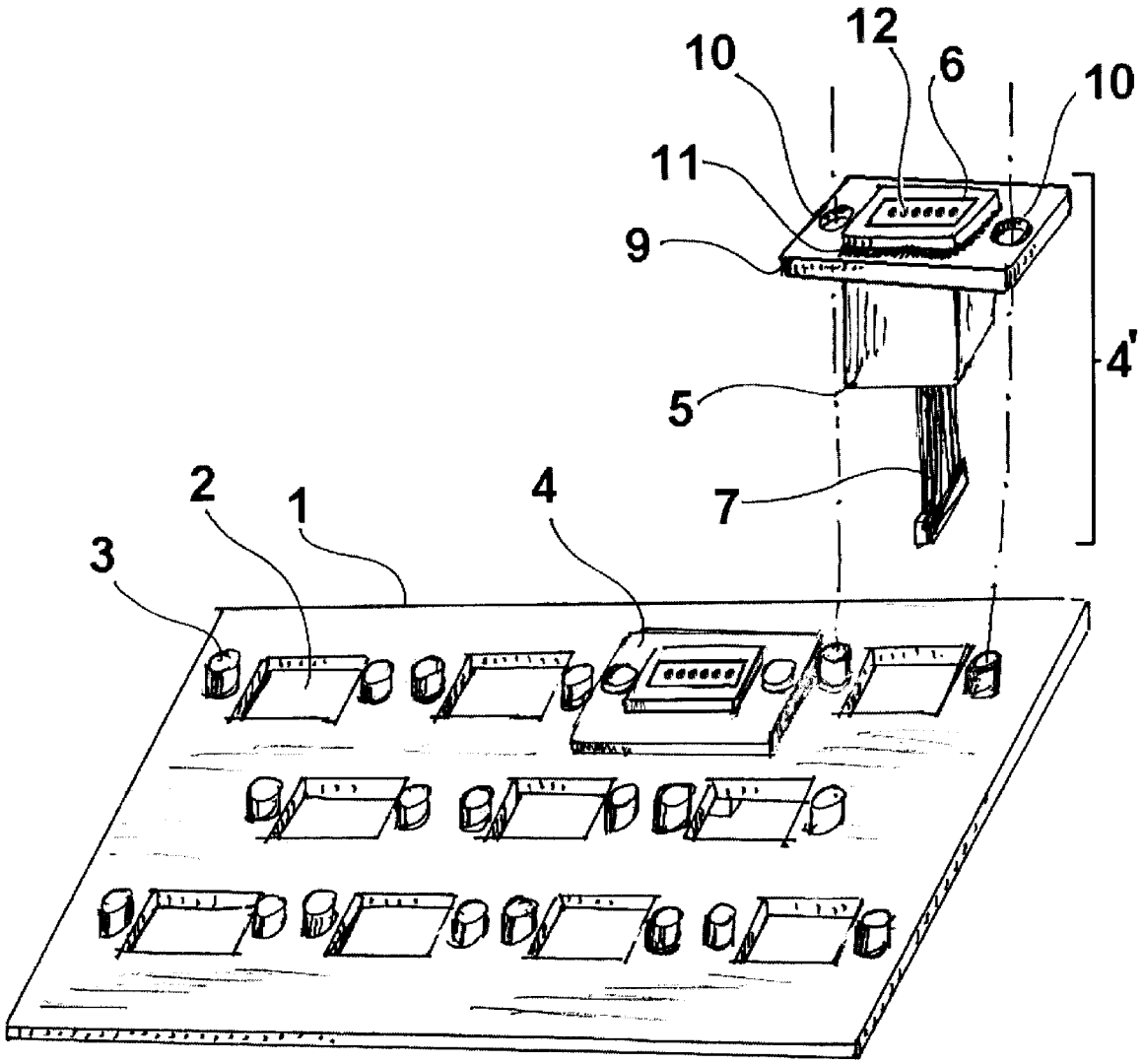
FIG. 1 shows a multi-head inkjet cartridge array built up from a collection of individual pre-registered inkjet cartridges.

FIG. 1 shows a multiple inkjet cartridge array head created via the method of the present invention. Array plate 1 comprises a number of openings 2, each of which has a plurality of precision registration pins 3. For the sake of clarity, FIG. 1 shows eleven openings 2 with their associated precision registration pins 3. In FIG. 1, one pre-registered cartridge subassembly 4 is shown accurately positioned and affixed to array plate 1 by means of its precision registration pins 3. A second pre-registered cartridge subassembly 4' is shown as removed from its mounted position. The completed array of this preferred embodiment accommodates eleven substantially identical pre-registered cartridge sub-assemblies 4. In practice, in the preferred embodiment of the present invention, the number of pre-registered cartridge subassemblies 4 may be a smaller or larger number than eleven. In a CMYK color system, it may be advantageous to have four pre-registered cartridge sub-assemblies; one for each of the four colors. In other applications, such as page-wide arrays, there may be many more pre-registered cartridge sub-assemblies 4. In such an implementation, the pre-registered cartridge sub-assemblies 4 are arranged in a coverage pattern that ensures that every addressable spot on the printable media may be addressed by one or more of the inkjet nozzles 12 in the array. It is clear to the practitioner in the field that a wide variety of such patterns exists.

Pre-registered cartridge subassembly 4 comprises a cartridge housing 5, a nozzle plate 6 and an electrical signal connection ribbon 7 through which the electrical functioning of the pre-registered cartridge subassembly 4 is controlled. It should be noted that some manufacturers fabricate the cartridge housing such as to include the ink reservoir, while others separate the reservoir from the housing. In the present application for letters patent the term cartridge housing is used to describe that part of the inkjet cartridge to which the nozzle plate is affixed, irrespective of whether an ink reservoir is included or not. In the present application for letters patent the term inkjet cartridge is therefore used to describe a cartridge which may or may not include an ink reservoir.

Intermediate fixture member 9 is permanently attached to cartridge housing 5, and has accurately positioned registration holes 10 that locate with precision registration pins 3. The positions and shapes of both the precision registration pins 3 and registration holes 10 may vary, but are matched such that registration holes 10 will locate with precision registration pins 3. Intermediate fixture member 9 is attached to cartridge housing 5 using an adhesive 11.

Figure 2:
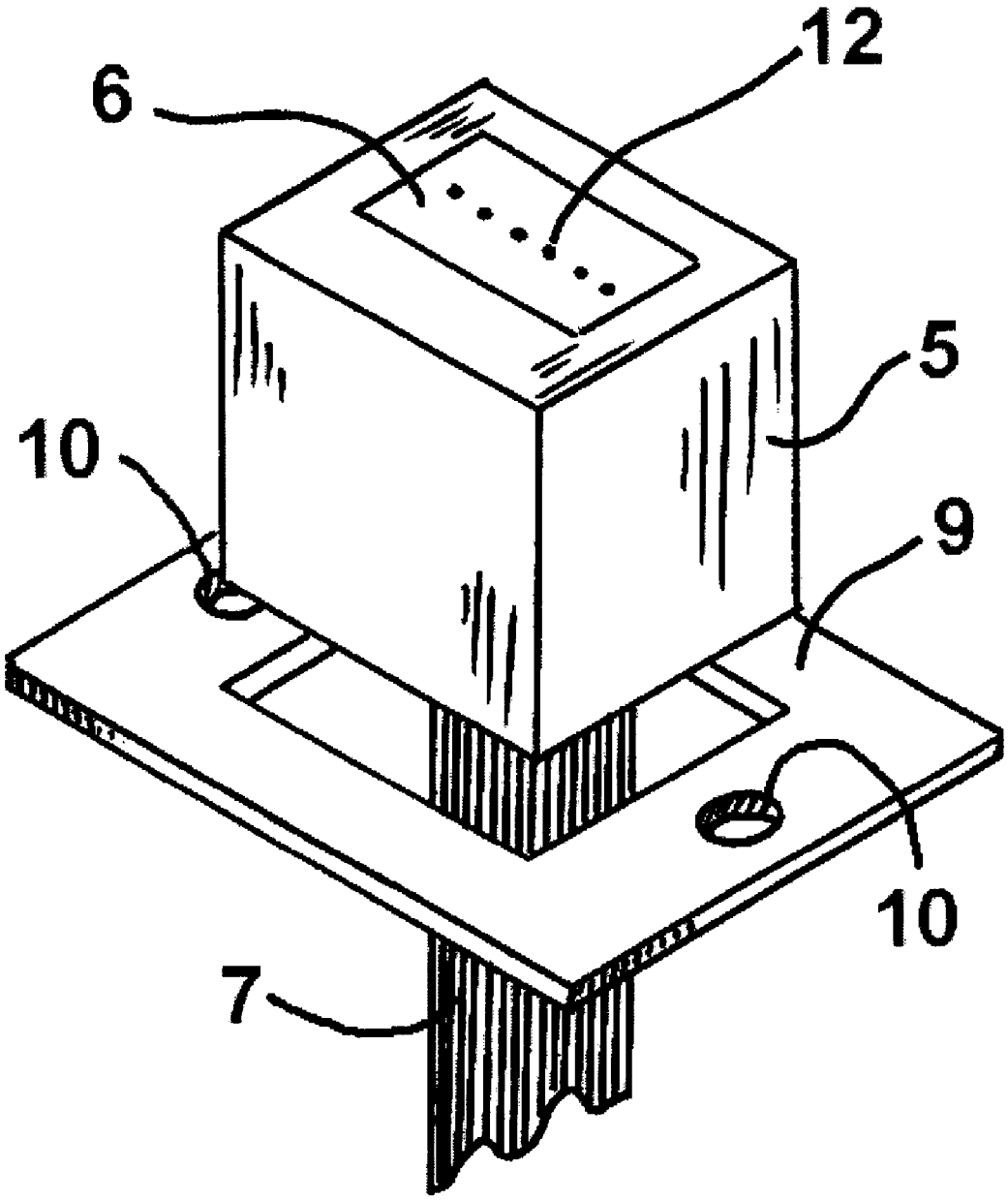
FIG. 2 shows a commercial inkjet cartridge and an intermediate fixture member as intermediate member separately.

FIG. 2 shows a standard low unit cost commercial inkjet cartridge and an intermediate fixture member separately. These two components are to be joined together, using the method of the present invention, to create the pre-registered cartridge subassembly 4 of FIG. 1. Employing consistent numbering with FIG. 1, an inkjet cartridge housing 5, has permanently attached to it an inkjet nozzle plate 6 comprising a collection of mutually highly accurately placed inkjet nozzles 12 through which the ink is ejected. Attached to inkjet cartridge housing 5 is an intermediate fixture member 9. By way of example, intermediate fixture member 9 may be made from steel of approximately 1 mm thickness, aluminum of approximately 2 mm thickness, epoxy fiberglass of approximately 2 mm thickness, or from ceramic. Other materials, capable of maintaining engineering precision, may optionally be employed.

Intermediate fixture member 9 may be permanently affixed to inkjet cartridge body 1 via a variety of adhesive techniques including fast curing epoxy and ultra-violet curable adhesive. In the preferred embodiment of the present invention an acrylic adhesive in the form of Scotch Weld DP460, provided by the 3M corporation of St. Paul Minn. is used.

An alternative attachment method is ultrasonic welding. Semi-permanent affixing, such as employing screws or bolts, can also be used. In the context of the present application for letters patent, the term "permanent" is used to describe affixing where affixed objects are not intended to be separated, while the term "removable" is used to describe affixing or mounting or placement of cartridges or subassemblies where such cartridges or subassemblies are to be replaced.

Figure 3:
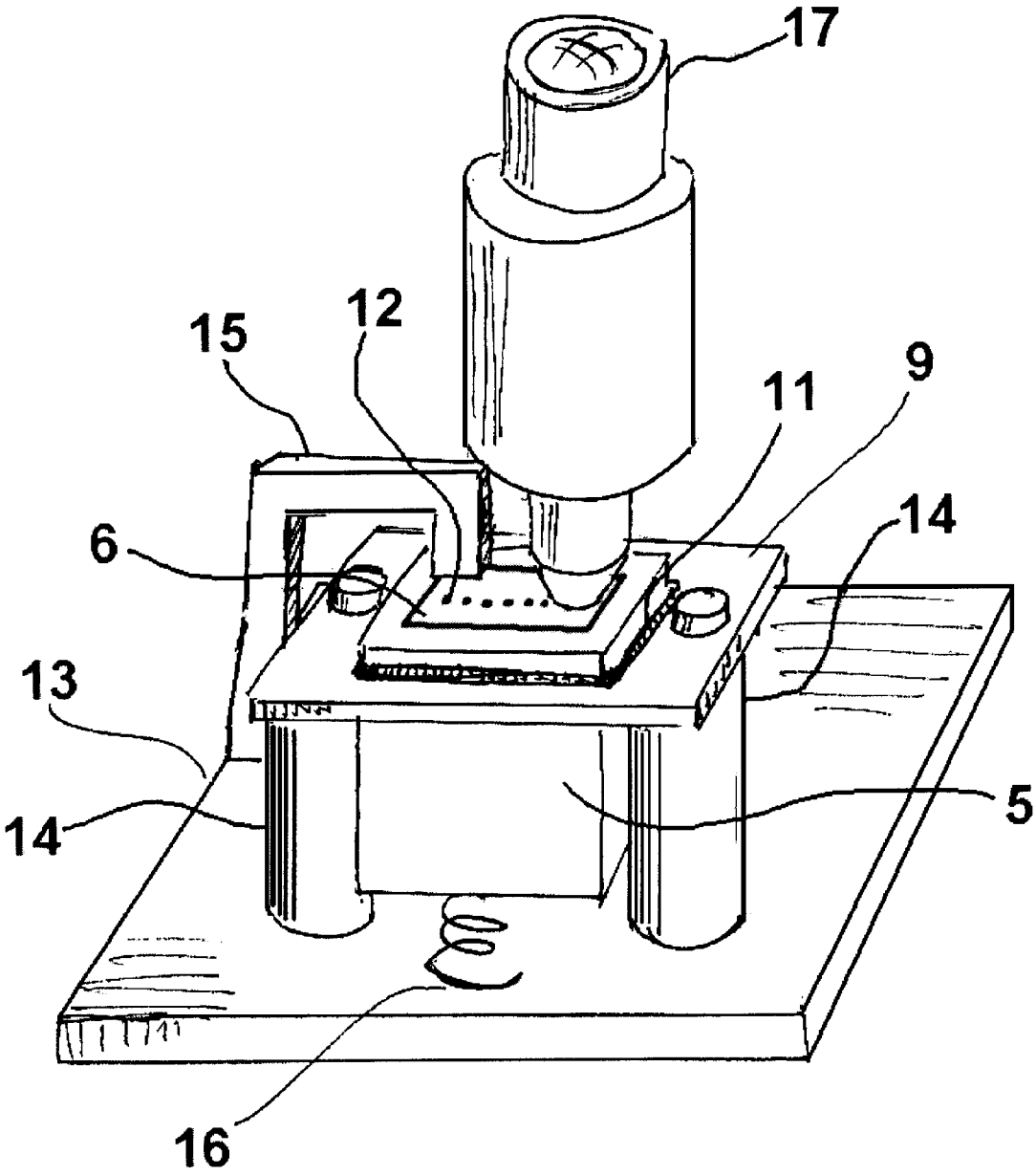
FIG. 3 shows an optical alignment apparatus used for joining an intermediate fixture member to an inkjet cartridge housing.

The actual process of joining or affixing intermediate fixture member 9 to cartridge housing 5 is undertaken on an optical alignment apparatus shown in FIG. 3. Microscope table 13 provides a base that may be moved to a precision greater than that required for the positioning of inkjet cartridge housing 5 with respect to intermediate fixture member 9. Affixed to microscope table 13 are two stepped-diameter locating pins 14 that are accurately positioned and sized to locate precisely with registration holes 10, which are shown as part of intermediate fixture member 9 in FIG. 2. Stepped diameter locating pins 14 serve to accurately keep intermediate fixture member 9 in a fixed position relative to microscope table 13. Height reference 15 serves to define the vertical positioning limit of inkjet nozzle plate 6 shown in FIG. 2. This ensures that the inkjet nozzles 12, which are commercially formed to great positional accuracy with respect to nozzle plate 6, will be at a precise vertical position with respect intermediate fixture member 9. This vertical accuracy is important in view of the close spacing between inkjet nozzles and the media onto which they eject, particularly in high-resolution systems. Spring 16 provides the force necessary to hold the vertical position of inkjet cartridge housing 5, and thereby the vertical position of inkjet nozzle plate 6, while adhesive 11 sets, dries, cures or solidifies so as to permanently affix intermediate fixture member 9 to cartridge housing 5. Microscope 17, which may be manual or automatic, is employed to determine the position of the inkjet nozzle plate 6, and the positions of the actual inkjet nozzles 12 in the plane parallel to that of microscope table 13. Clearly the opening in intermediate fixture member 9 should allow sufficient adjustment of inkjet cartridge housing 5 (typically 0.1 to 1.0 millimeter). For best stability the adjustment range should be no larger than required, particularly when adhesive is used to secure inkjet cartridge housing 5 to intermediate fixture member 9.

The accuracy of this positioning is clearly limited by the placement accuracy with which the inkjet nozzles 12 have been fashioned in the inkjet nozzle plate 6. Nozzle placement accuracies of the order of a micron are achievable during the commercial volume production of the inkjet nozzle plates 6. The accurate positioning of inkjet nozzle plate 6 and inkjet nozzles 12 with respect to intermediate fixture member 9 via manipulation of inkjet cartridge housing 5 is entirely practicable, as optical components are adjusted to sub-micron tolerances in the laser industry.

When intermediate fixture member 9 has been attached to inkjet cartridge housing 5, all materials are allowed to set or cure as may be required by the particular choice of materials. By this method an inkjet cartridge sub-assembly 4 is obtained, in which the inkjet nozzles 12 are spatially located highly accurately with respect to intermediate fixture member 9 and, in particular, with respect to the registration holes 10 within intermediate fixture member 9.

By the method described here, commercially manufactured inkjet cartridges may therefore be combined with intermediate fixture members to fabricate spatially referenced inkjet cartridge sub-assemblies in which the positions of all inkjet nozzles are registered to an accuracy of a micron or better, limited only by the accuracy of nozzle manufacture.

One such desired accurate positioning is to ensure that the spacing of nozzles along the direction perpendicular to the motion of the media being printed on is constant across the entire array within an accuracy equal or approximately equal to that of the alignment of intermediate fixture member 9 to inkjet nozzles 12. This is achieved by staggering the individual spatially referenced inkjet cartridge sub-assemblies as shown in FIG. 1, and allows the building of so-called page-wide inkjet printer array heads.

It should be noted that, while most commercial inkjet cartridges housings are manufactured form a variety of engineering plastics, some commercial inkjet cartridges are manufactured in such a way that the housing contains a metal member within which the inkjet nozzle plate 6 is positioned or to which it is attached. In the preferred embodiment of the present invention, intermediate fixture member 9 is permanently affixed to such a metal member. In an alternative embodiment, pertaining when such metal members are absent, registration fixture 9 is affixed to the engineering plastic inkjet cartridge housing 5.

Turning now to FIG. 4*a* and FIG. 4*b*, an alternative method of placement of pre-registered cartridge subassembly 4 on array plate 1 is shown. To the extent that intermediate fixture member 9 may be manufactured from a material with a thermal expansion coefficient that differs substantially from that of array plate 1, one of the two registration holes 10 in intermediate fixture member 9 may be slotted so as to ensure that thermal expansion is allowed for. FIG. 4*a* shows a pre-registered cartridge subassembly 4 mounted on array plate 1 at a first temperature $T_1$, while FIG. 4*b* shows the same arrangement at a higher temperature $T_2$, where expansion has occurred. It should be noted that, in the case of arrays containing pre-registered cartridge subassemblies 4 that have to print adjoining tracks on the printing media, It is preferred that intermediate fixture member 9 and array plate 1 are manufactured from the same material, or materials with matching thermal expansion coefficients.

Since the exact position of every nozzle on the spatially referenced inkjet cartridge sub-assembly 4 is known, other such spatially referenced inkjet cartridge sub-assemblies may be positioned on array plate 1 in such a way that the individual inkjet nozzles on all the sub-assemblies may be positioned accurately with respect to one another. Array plate 1 may be mounted on the carriage of an inkjet printer, in the case where the inkjet cartridge array does not constitute a page-wide system, or on a member that is stationary, in the case of an ink-jet cartridge array that is page-wide. The term carriage is used in this application for letters patent to describe the member to which the completed array is attached on the inkjet printer, irrespective of whether this member moves or not. In this application for letters patent the term common fixture member is used to describe the general case of the common member on which the spatially referenced or preregistered inkjet cartridge subassemblies are mounted, whether it be a moving or fixed carriage, or other structure fulfilling the role.

It is well-known to those skilled in the art that a variety of interlacing schemes exist by which it may be ensured that full coverage of a page of media may be obtained from a repeatedly scanned single inkjet head or, indeed, from an assemblage of staggered inkjet heads. These schemes will not be dwelt upon in this application for letters patent. The important factor is that the relative positioning of the individual inkjet nozzles from different cartridges needs to be accurate to a tolerance greater than the dots to be printed per inch. That is, in order to print 1200 dots per inch, the center-to-center spacing between lines of dots has to be 21.2 microns. This requires dots to be placed with accuracy of the order of ±5 microns. As a result, the mutual positioning of different nozzles in the multi-head array therefore has to be accurate to better than ±5 microns.

In this present application for letters patent the term intermediate fixture member is used to describe any three-dimensional structure employed to the same purpose of spatial registration of inkjet nozzles as intermediate fixture member 9 described here. The term spatial registration is used here to describe the determination and fixing of the exact position and orientation of one three-dimensional body with respect to another in three dimensions. The term spatially registered array of individual inkjet cartridges is used to describe an array of cartridges, the inkjet nozzles of which are located in a regular pattern, with all the inkjet nozzles of all the individual cartridges being in spatial registration with respect to one another. The term spatially registered inkjet nozzle array is used to describe an array of inkjet nozzles that are located in a regular pattern with all the inkjet nozzles being in spatial registration with respect to one another.

By the method of the present invention, this required nozzle placement accuracy is obtained, and allows a large number of inkjet cartridges to be turned into individual spatially registered inkjet cartridge sub-assemblies. These subassemblies may be placed in a staggered array on a common member, represented by array plate 1 in FIG. 1, so as to create not only large arrays, but, in fact, page-wide arrays.

It is also evident that pre-registered inkjet cartridge sub-assemblies may be combined into two-dimensional arrays. In such systems, the inkjet nozzles from more than one cartridge may be employed to address the same spot on the media even if there is no carriage motion, as in a page-wide array. This arrangement allows higher speed printing as well as nozzle redundancy.

While the present application for letters patent describes a registration process that locates an inkjet cartridge in all degrees of freedom, some degrees of freedom can be adjusted electronically and need not be part of the mechanical registration. By way of example, any position error in the scanning direction can be compensated by electronic timing changes. The trade-off between full or partial mechanical registration is well known in the art.

There has thus been outlined the important features of the present invention in order that it may be better understood, and in order that the present contribution to the art may be better appreciated. Those skilled in the art will appreciate that the conception on which this disclosure is based may readily be utilized as a basis for the design of other apparatus and methods for carrying out the several purposes of the invention. It is most important, therefore, that this disclosure be regarded as including such equivalent apparatus and methods as do not depart from the spirit and scope of the invention.

What is claimed is:

1. A method for building a spatially registered inkjet nozzle array from a plurality of individual inkjet cartridges, the method comprising:

permanently spatially registering the inkjet nozzles of each of the individual inkjet cartridges to an intermediate fixture member and removably registering the intermediate fixture members to one another on a common fixture member wherein spatially registering the inkjet nozzles is performed optically.

2. A method as in claim 1, wherein the members of the plurality of inkjet cartridges are combined into a two-dimensional inkjet array on the common fixture member.

3. A method for building a spatially registered inkjet nozzle array from a plurality of individual inkjet cartridges each having a plurality of individual inkjet nozzles to print on media capable of having relative movement with respect to the array, the individual inkjet nozzles having a substantially constant spacing along a direction perpendicular to the relative movement of the media, the method comprising:

providing a first plurality of individual inkjet cartridges and a second plurality of individual intermediate fixture members, permanently spatially registering the inkjet nozzles of individual inkjet cartridges to the individual intermediate fixture members, and removably registering the intermediate fixture members to one another on a common fixture member wherein spatially registering the inkjet nozzles is performed optically.

4. A method as in claim 3, wherein the members of the first plurality of inkjet cartridges are combined into a two-dimensional inkjet array on the common fixture member.

5. A method for building a spatially registered inkjet nozzle array from a first plurality of individual inkjet cartridges, each individual inkjet cartridge comprising a second plurality of inkjet nozzles, the second plurality of inkjet nozzles on an individual inkjet cartridge having a substantially regular inter-nozzle spacing in at least one dimension, the method comprising:

providing a first plurality of inkjet cartridges and a third plurality of intermediate fixture members, fabricating a fourth plurality of pre-registered inkjet cartridge sub-assemblies by permanently spatially pre-registering to an intermediate fixture member the inkjet nozzles of individual inkjet cartridges, the individual inkjet cartridges being members of the first plurality of inkjet cartridges, and removably registering to one another the members of the fourth plurality of pre-registered inkjet cartridge sub-assemblies by mutually spatially registering the intermediate fixture member of each of the fourth plurality of pre-registered inkjet cartridge sub-assemblies on a common fixture member wherein spatially registering the intermediate fixture members is performed optically.

6. A method as in claim 5, wherein the members of the first plurality of inkjet cartridges are combined into a two-dimensional inkjet array on the common fixture member.

7. A method for aligning the inkjet nozzles of a plurality of inkjet cartridges when the inkjet cartridges are installed on the carriage of an inkjet printer, the method comprising:

providing a first plurality of inkjet cartridges, each member of the first plurality of inkjet cartridges comprising a second plurality of inkjet nozzles, the members of the second plurality of inkjet nozzles being substantially regularly spaced in at least one dimension, providing a third plurality of intermediate fixture members, spatially registering at least one inkjet nozzle of a first member selected from the first plurality of inkjet cartridge members to a second member taken from the third plurality of intermediate fixture members creating a spatially registered inkjet cartridge sub-assembly by permanently affixing the first member to the second member while the spatial registration between the at least one inkjet nozzle and the second member is maintain and removably attaching to the carriage a fourth plurality of spatially registered inkjet cartridge sub-assemblies with their inkjet nozzles aligned to address tracks with a regular spacing wherein spatially registering at least one inkjet nozzle is performed optically.

8. A method as in claim 7, wherein the members of the first plurality of inkjet cartridges are combined into a two-dimensional inkjet array on a common fixture member.

9. A method as in claim 7, wherein the substantially regular spacing is a constant spacing.

10. A method as in claim 7, wherein at least two of the members of the fourth plurality of spatially registered inkjet cartridge subassemblies are offset with respect to one another in a direction of motion of the media printed upon.

11. A method as in claim 7, wherein the carriage and the intermediate fixture members comprise a same material.

12. A method for aligning the inkjet nozzles of a plurality of inkjet cartridges when the inkjet cartridges are installed on the carriage of an inkjet printer, the method comprising:

providing a first plurality of inkjet cartridges, each member of the first plurality of inkjet cartridges comprising a second plurality of inkjet nozzles, the members of the second plurality of inkjet nozzles being substantially regularly spaced in at least one dimension, providing a third plurality of intermediate fixture members, spatially registering at least one inkjet nozzle of a first member selected from the first plurality of inkjet cartridge members to a second member taken from the third plurality of intermediate fixture members creating a spatially registered inkjet cartridge sub-assembly by permanently affixing the first member to the second member while the spatial registration between the at least one inkjet nozzle and the second member is maintained and removably attaching to the cartridge a fourth plurality of spatially registered inkjet cartridge sub-assemblies with their inkjet nozzles aligned to address tracks with a regular spacing wherein the removable attaching is performed by providing at least on member of the fourth plurality of spatially registered inkjet cartridge subassemblies with a means for expansion and contraction with respect to the carriage in at least one dimension.

13. A method for aligning the inkjet nozzles of a plurality of inkjet cartridges when the inkjet cartridges are installed on the carriage of an inkjet printer, the method comprising:

providing a first plurality of inkjet cartridges, each member of the first plurality of inkjet cartridges comprising a second plurality of inkjet nozzles, the members of the second plurality of inkjet nozzles being substantially regularly spaced in at least one dimension, providing a third plurality of intermediate fixture members, spatially registering at least one inkjet nozzle of a first member selected from the first plurality of inkjet cartridge members to a second member taken from the third plurality of intermediate fixture members creating a spatially registered inkjet cartridge sub-assembly by permanently affixing the first member to the second member while the spatial registration between the at least one inkjet nozzle and the second member is maintained and removably attaching to the carriage a fourth plurality of spatially registered inkjet cartridge sub-assemblies with their inkjet nozzles aligned to address tracks with a regular spacing wherein the carriage and the intermediate fixture members comprise materials with substantially equal thermal expansion coefficients.

14. A spatially registered array of inkjet cartridges for printing on a media, the array comprising a plurality of inkjet cartridge subassemblies, each of the inkjet cartridge subassemblies comprising a plurality of inkjet cartridges, each of the inkjet cartridges comprising a nozzle array with substantially regular inter-nozzle spacing in at least one dimension, and a plurality of intermediate fixture members wherein each individual inkjet cartridge of the plurality of inkjet cartridges is permanently affixed to an individual intermediate fixture member of the plurality of intermediate fixture members, the nozzle array of the individual inkjet cartridge being in a spatially registered relationship with the individual intermediate fixture member and a common fixture member to which the plurality of inkjet cartridge subassemblies are removably affixed in a mutually spatially registered arrangement wherein the spatial registration is performed optically.

15. An apparatus as in claim 14, wherein the members of the plurality of inkjet cartridge subassemblies are combined into a two-dimensional inkjet array on the common fixture member.

16. An apparatus as in claim 14, wherein the substantially regular spacing is a constant spacing.

17. An apparatus as in claim 14, wherein at least two of the members of the plurality of inkjet cartridge subassemblies are offset with respect to one another in a direction of motion of the media.

18. An apparatus as in claim 14, wherein the common fixture member and the intermediate fixture members comprise a same material.

19. A spatially registered array of inkjet cartridges for printing on a media, the array comprising a plurality of inkjet cartridge subassemblies, each of the inkjet cartridge subassemblies comprising a plurality of inkjet cartridges, each of the inkjet cartridges comprising a nozzle array with substantially regular inter-nozzle spacing in at least one dimension, and a plurality of intermediate fixture members wherein each individual inkjet cartridge of the plurality of inkjet cartridges is permanently affixed to an individual intermediate fixture member of the plurality of intermediate fixture members, the nozzle array of the individual inkjet cartridge being in a spatially registered relationship with the individual intermediate fixture member and a common fixture member to which the plurality of inkjet cartridge subassemblies are removably affixed in a mutually spatially registered arrangement wherein at least one member of the fourth plurality of spatially registered inkjet cartridge subassemblies is provided with a means for expansion and contraction with respect to the carriage in at least one dimension.

20. A spatially registered array of inkjet cartridges for printing on a media, the array comprising a plurality of wet cartridge subassemblies, each of the inkjet cartridge subassemblies comprising a plurality of inkjet cartridges, each of the inkjet cartridges comprising a nozzle array with substantially regular inter-nozzle spacing in at least one dimension, and a plurality of intermediate fixture members wherein each individual inkjet cartridge of the plurality of inkjet cartridges is permanently affixed to an individual intermediate fixture member of the plurality of intermediate fixture members, the nozzle array of the individual inkjet cartridge being in a spatially registered relationship with the individual intermediate fixture member and a common fixture member to which the plurality of inkjet cartridge subassemblies are removably affixed in a mutually spatially registered arrangement wherein the common fixture member and the intermediate fixture members comprise materials with substantially equal thermal expansion coefficients.

* * * * *